United States Patent [19]

Van Bokestal et al.

[11] Patent Number: 4,835,370

[45] Date of Patent: May 30, 1989

[54] SELF-REGULATING HEATING ELEMENT

[75] Inventors: André M. A. Van Bokestal; Henri L. P. Lorrain, both of Brussels, Belgium

[73] Assignee: U.S. Philips Corporation, New York, N.Y.

[21] Appl. No.: 165,428

[22] Filed: Mar. 1, 1988

Related U.S. Application Data

[62] Division of Ser. No. 4,923, Jan. 20, 1987.

[30] Foreign Application Priority Data

Jan. 23, 1986 [NL] Netherlands ..... 8600142

[51] Int. Cl.[4] ..... H05B 3/14

[52] U.S. Cl. ..... 219/544; 219/541; 219/504

[58] Field of Search ..... 219/541, 544, 548, 549, 219/528, 504, 505, 543

[56] References Cited

U.S. PATENT DOCUMENTS 3,233,028 2/1966 Toppari et al. ..... 264/272.13
4,086,467 4/1978 Grant ..... 219/541
4,104,509 8/1978 Van Bokestal et al. ..... 219/544
4,147,927 4/1979 Pirotte ..... 219/541
4,330,929 5/1982 Cripe ..... 264/272.18

OTHER PUBLICATIONS

*Electronic Design* 3, Feb. 1, 1968, pp. 50–59, 62–67, 70–79.

*Electrical Commnication,* "Plastic Encapsulation of Components", Whitby et al., vol. 43, No. 3, 1968, pp. 220–226.

*Primary Examiner*—Teresa J. Walberg
*Attorney, Agent, or Firm*—Norman N. Spain

[57] ABSTRACT

A self-regulating heating element having a resistor with a positive temperature coefficient as a heat source, the resistor(s) being located within a thermoplastic casing between metal parts which it (they) contact(s) in a heat-exchanging manner. For safety the element is provided with a double insulation: one part which is manufactured by moulding and which is, secondly, provided internally and/or externally with a layer of an elastomer by means of a solution.

4 Claims, 1 Drawing Sheet

SELF-REGULATING HEATING ELEMENT

This is a division of application Ser. No. 004,923, filed Jan. 20, 1987.

BACKGROUND OF THE INVENTION

The invention relates to a self-regulating heating element which comprises as a heat source at least one resistor body of a material having a positive temperature coefficient of electrical resistance (hereinafter termed PTC resistor).

U.S. Pat. No. 4,147,927 describes such a heating element which is characterized in that the resistor body or resistor bodies is or are situated between metal bodies which, on the side facing away from the resistor body or resistor bodies, contact the inner surface of the casing in a heat-exchanging and abutting manner.

In accordance with the above-mentioned Patent Specification, the casing can be made of glass, ceramics or a heat-conducting elastic synthetic resin, if desired in a metal outer casing.

U.S. Pat. No. 4,104,509 describes a casing material which in practice best satisfies the requirements, said material consisting of a vulcanised synthetic resin material which is capable of resisting the highest operating temperature of the element, an electrically insulating, heat-conducting metal compound and, if desired, an additional filler material.

Preferably, the vulcanised synthetic resin material is silicone rubber. Magnesium oxide, trivalent iron oxide or aluminum oxide may be used as a heat conducting metal compound and silicon dioxide as a filler material.

For safety it is desired to surround the PTC resistors and the encasing metal bodies by a double insulation because the assembly is connected to the mains. Due to an error, for example, in the composition of the casing or the hardening depth, the casing of the elements may crack during use in which case it is very important that there is a second casing of a more elastic material which safeguards the user of the element from contacting the live metal parts.

Moulding the interengageable parts of the casing or encapsulating a moulded part with a second material are methods which in practice have too many drawbacks, and which cannot be automated.

A further possibility is to encapsulate the assembly of PTC resistor(s) and the encasing metal parts with an insulating synthetic resin foil, for example, of polyimide, before it is slid into the moulded casing. However, this method is complicated and costly too.

BRIEF SUMMARY OF THE INVENTION

The invention is characterized in that on the inside and/or outside surface of a molded thermoplastic casing a layer of an elastomer is provided from a solution.

DETAILED DESCRIPTION OF THE INVENTION

By means of a solution the elastomer is provided in the form of a layer. Preferably, the elastomer has a viscosity which is higher than that of the molded casing and varies from 200 mPa.sec. to 1,000,000 mPa.sec. This means that the layer has a higher elasticity than the molded casing.

The elastomer may be of the addition-polymerisation type of a silicone resin with two components or of the condensation-polymerisation type. The two-component silicone resin may comprise a polysiloxane polymer to which reactive vinyl groups have been grafted and a hydrosiloxane, and may further comprise a platinum salt as a catalyst. In applying the layer a solution in a simple solvent is used, for example xylene, or a mixture of solvents which is made to evaporate after it has been applied. Filler materials such as metal oxides having a high thermal conductivity, dyes or stabilisers may be added to the solution of the elastomer.

When an layer is to be applied to the outside of the molded casing, this can be done by immersion. An inner layer is obtained by filling the molded casing with the solution and then pouring it out so that a layer is formed on the walls of the casing. Preferably, the solution is vibrated during the contact with the pressed part in order to obtain a layer having a constant thickness. After the solution has been applied, it is dried, for example for 10 minutes at 175° C. and heated, for example for 4 hours at 200° C. to promote further polymerisation.

The apparatus in accordance with the invention has many advantages. The transfer of the moulded casing to a filling arrangement or an immersion arrangement can readily be automated. Furthermore, the diameter of the element can be reduced to less than 8 mm., which dimension is, in practice, a favourable one. Moreover, when due to an error a crack develops in the moulded part the more elastic second casing which is provided by means of a liquid will remain intact and locally, at the location of the crack, become detached from the molded casing so that no live metal parts will be exposed.

Figure 1:
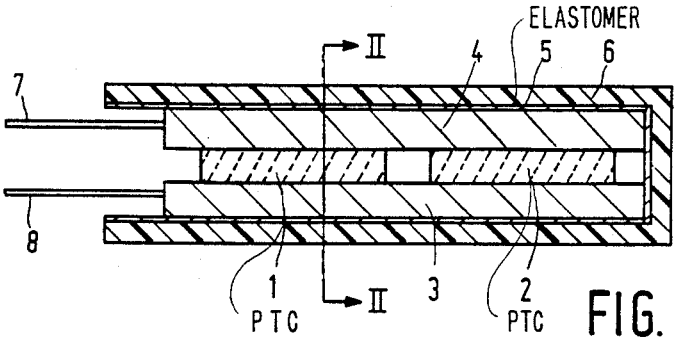
FIG. 1 is a longitudinal view of a heating element manufactured in accordance with the invention.
Figure 2:
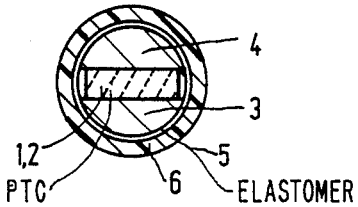
FIG. 2, is a cross-sectional view along II—II of the element of FIG. 1.

FIGS. 1 and 2 represent resistor bodies 1 and 2 which have a positive temperature characteristic of resistance. These resistor bodies are fixed between two semicylindrical metal bodies 3 and 4, for example, consisting of aluminum. The casing 6 which is molded, for example, from a vulcanised silicone rubber which is filled with magnesium oxide and silicone dioxide is coated on the inside between the molded casing 6 and the metal bodies 3 and 4 with a layer 5 consisting of a silicone elastomer which, at room temperature, has a viscosity of $10^6$ mPa.sec.

Figure 3:
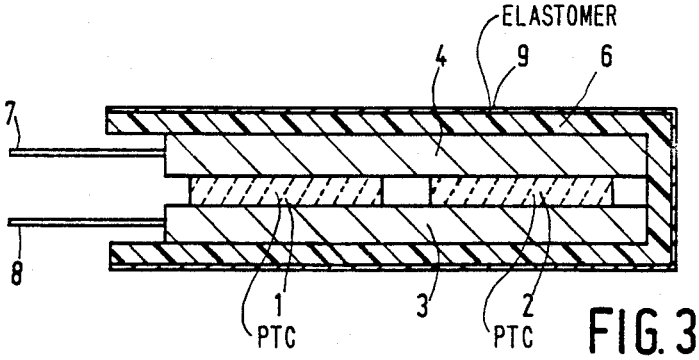
FIG. 3 is a longitudinal sectional view of a different embodiment of a heating element manufactured in accordance with the invention.

FIG. 3 shows a heating element which only differs from that of FIG. 1 in that the layer 5 on the inside of the molded casing is substituted by a similar layer 9 at the outside thereof.

What is claimed is:

1. A self-regulating heating element which comprises as a heat source at least one resistor body of a material having a positive temperature coefficient of electrical resistance, the at least one resistor body being positioned between and contacting metal bodies in a heat-exchanging manner, which metal bodies on a side facing away from the at least one resistor body contact an inner surface of a molded casing in a heat-exchanging manner, which casing encloses said metal bodies and consists of a molded thermoplastic vulcanized synthetic resin, characterized in that at least one surface of the casing is provided with a layer of an electrically insulating elastomer in direct contact with said casing.

2. A self-regulating heating element as claimed in claim 1, characterized in that the electrically insulating elastomer is more elastic than the material of the molded casing.

3. A self-regulating heating element as claimed in claim 2, characterized in that the elastomer comprises the polymerization product of a mixture of a polysiloxane polymer to which reactive groups have been grafted and a hydrosiloxane.

4. A self-regulating heating element as claimed in claim 1, characterized in that the elastomer comprises the polymerization product of a mixture of a polysiloxane polymer to which reactive groups have been grafted and a hydrosiloxane.

* * * * *